United States Patent [19]

Staempfli

[11] 4,379,580

[45] Apr. 12, 1983

[54] GRAPNEL

[75] Inventor: Jackie Staempfli, Geneva, Switzerland

[73] Assignee: Valinor, S.A., Vaduz, Liechtenstein

[21] Appl. No.: 263,734

[22] Filed: May 14, 1981

[30] Foreign Application Priority Data

May 22, 1980 [CH] Switzerland ..... 4004/80

[51] Int. Cl.[3] ..... B66C 1/10; F42B 13/56

[52] U.S. Cl. ..... 294/86 R; 102/504; 114/305; 294/66 R; 294/97; 294/116

[58] Field of Search ..... 294/66 R, 86.25, 93–98, 294/116, 120, 125–130, 86 R; 43/6; 52/160; 102/504; 114/294, 297, 298, 301, 302, 304–307; 182/50

[56] References Cited

U.S. PATENT DOCUMENTS

| | | | |
|---|---|---|---|
| 19,659 | 3/1858 | Williams | 114/305 |
| 858,009 | 6/1907 | Meyer et al. | 102/504 |
| 890,499 | 6/1908 | Clough | 114/305 X |
| 999,795 | 8/1911 | Jones | 114/305 X |
| 1,295,076 | 2/1919 | Sherman et al. | 114/305 |
| 1,753,737 | 4/1930 | Bohm | 114/305 |
| 4,057,024 | 11/1977 | Adams | 114/305 X |

*Primary Examiner*—Johnny D. Cherry

*Attorney, Agent, or Firm*—Cushman, Darby & Cushman

[57] ABSTRACT

A grapnel is disclosed which comprises a plurality of arms pivotably mounted on a substantially rod shaped body. The arms have at their free ends catching points forming an angle with the arms and near the foot of the catching points auxiliary catching claws extend substantially in the direction of the arms. A piston and cam-shaped portions of the grapnel arms co-operate to urge the arms into an outwardly extending position upon a traction on the grapnel rope.

8 Claims, 4 Drawing Figures

GRAPNEL

Figure 1:
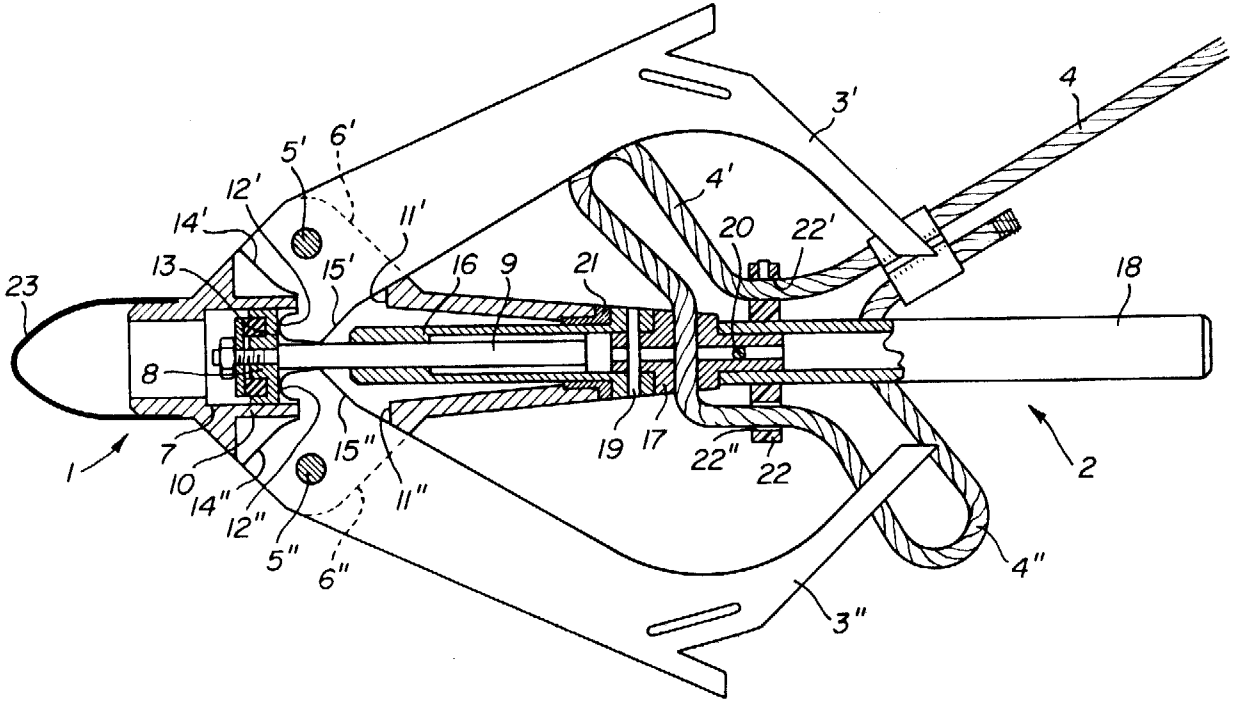

The present invention relates to a grapnel device comprising a substantially rod-shaped body, a plurality of grapnel arms and means for attaching a rope. More particularly the invention relates to a grapnel of the kind wherein the body comprises first and second body parts in longitudinally movable relationship with each other and said grapnel arms are pivotally mounted on said first body part for pivoting between a retracted position close to the body and a position in which they are outwardly extending from that body.

Most of the known grapnels comprise fixed arms and are intended to be thrown by hand which of course does not allow to attain wide distances. On the other hand if propelling of the grapnel by means of a rocket type device is used, the precision of the launching appears very often to be quite insufficient.

To overcome this inconvenience it can be considered to launch the grapnel along a ballistic trajectory by means of a launching device providing a very high acceleration and speed at the start so as to achieve a very good precision and to attain a long distance. However, it appears that the mechanical resistance of fixed arms must in this case be extremely high to avoid a deformation under the effect of the acceleration at the start, since the same can reach values up to 13000 g. in particularly effective launching devices and the speed at the muzzle of such a device can be more than 150 m/sec. for a grapnel of about 2 kg.

This leads to consider a grapnel design wherein the arms are pivotally mounted so as to be capable of adopting a retracted position close to the body at least at the start, i.e. during the acceleration phase and during the flight at high speed.

A grapnel has already been proposed with pivotable arms which operates in the way of an umbrella, the arms being intended to open under the effect of the impact of the grapnel falling down on its head part. This is achieved by means of lead inertia parts connected to a tube which is slidably mounted on a body part of the grapnel bearing the pivotable arms.

Such a grapnel can, however, neither be built sufficiently strongly, nor be made sufficiently reliable as it does not open under all circumstances. Furthermore, the weight of the inertia parts unnecessarily increases the weight of the whole grapnel.

The present invention has for object to overcome the disadvantages of the known grapnels and more particularly to provide a grapnel which can be launched at a very high speed, which has a relatively low weight and air resistance and which is utmost reliable in operation. Another object of the invention is to provide a grapnel which allows its arms to be opened after its falling down on any kind and condition of ground.

In accordance with the invention, each grapnel arm comprises a cam-shaped portion adapted to co-operate with an actuating piston coupled to a movable body part so as to urge said arms into an outwardly extending position when said body part is longitudinally moved with respect to a first body part by a traction on the rope of the grapnel.

To make the opening of the grapnel arms even more reliable, each arm can comprise, at its free end, a catching point forming an angle with said arm and comprise, near the foot of said catching point, an auxiliary catching claw extending substantially in the direction of said arm and/or comprise sidewardly extending blade-like catching members.

According to a preferred embodiment, the grapnel comprises a guiding rod for launching the grapnel along a ballistic trajectory by means of a launching tube and means to assure that the grapnel rope is attached in the stretched condition of the rope at the free end of the guiding rod.

Figures 2, 3:
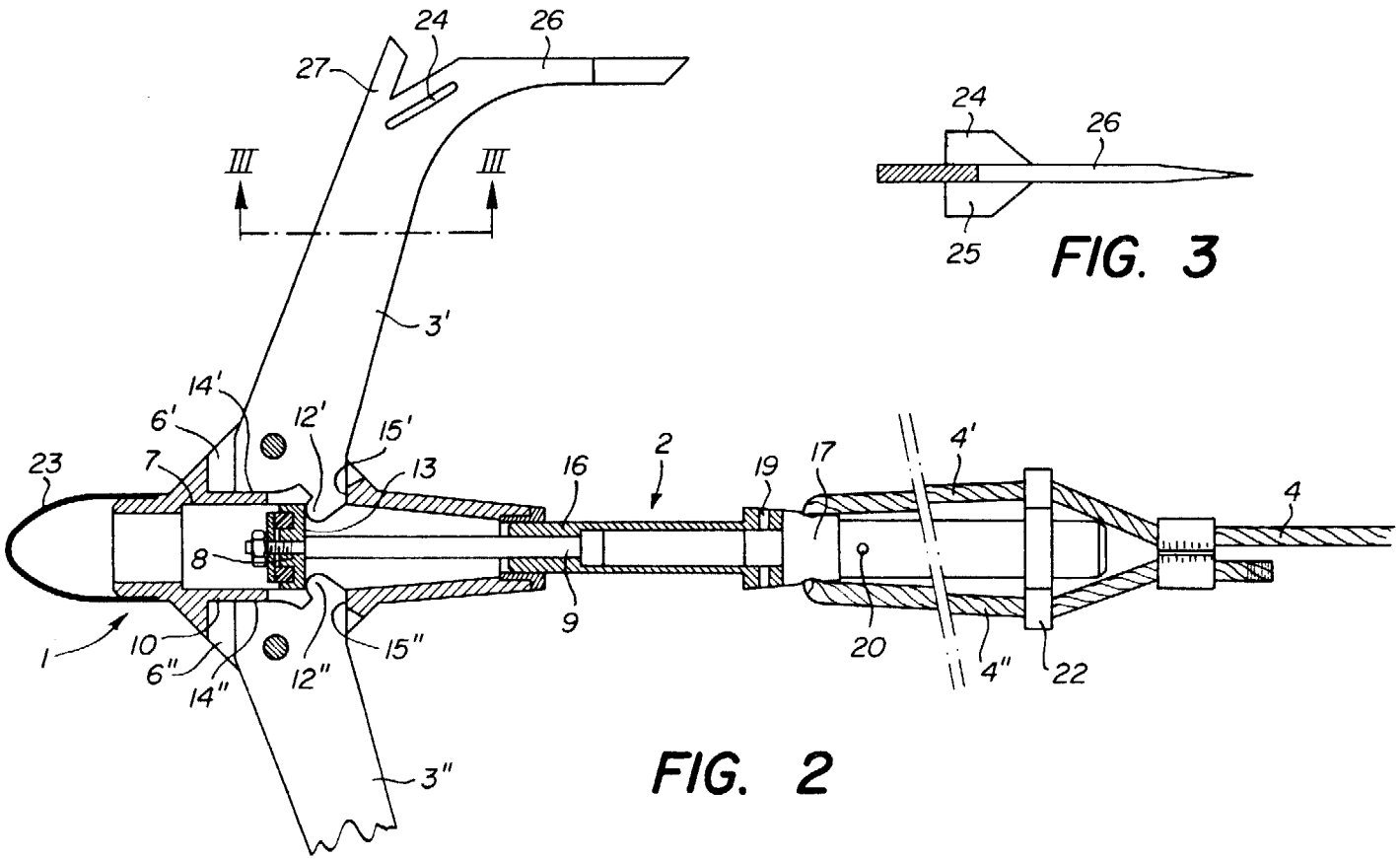
Figure 4:
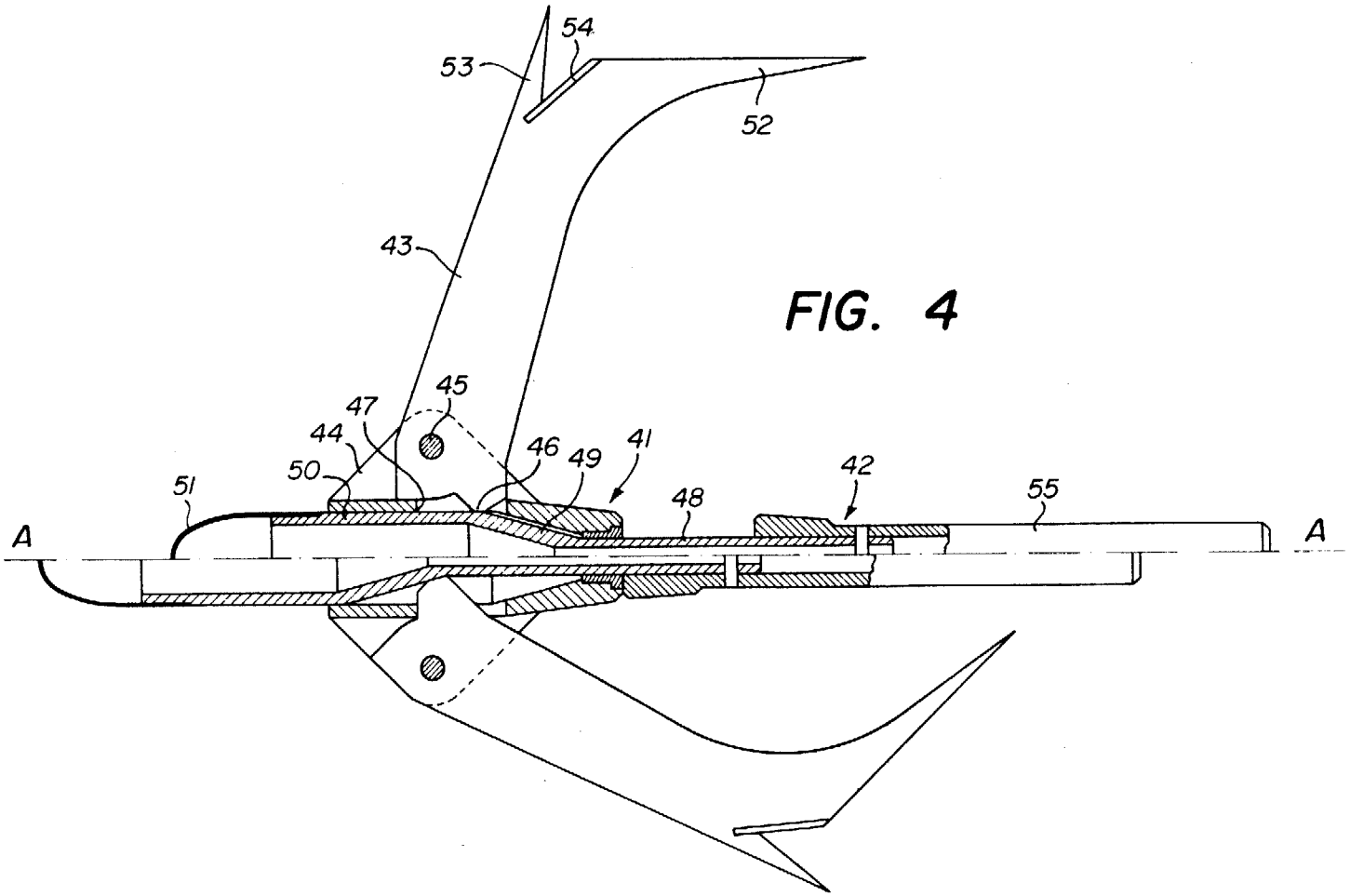

Further objects and advantages of the invention will appear from the following description in which, by way of example only, two preferred embodiments are described with reference to the accompanying drawings of which:

FIG. 1 is an elevation, partially in section, of a first embodiment of a grapnel according to the invention represented with the arms in the retracted position;

FIG. 2 is a similar view of the same grapnel with the arms in the opened position, FIG. 3 is a view of the end portion of an arm from the section line III—III of FIG. 2, and FIG. 4 is an elevation, partially in section, of a second embodiment of the grapnel of the invention, one half of the grapnel on one side of the center line A—A showing the outwardly extending position of an arm and the other half showing the retracted position of said arm.

The grapnel represented in FIGS. 1 to 3 comprises a body having two main parts, namely a head part designated as a whole by 1 and a tail part designated as a whole by reference 2. On the head part a plurality of grapnel arms, for instance four arms such as arms 3' and 3" of the drawing, are pivotally mounted, and at the tail part a rope 4 is attached to the grapnel.

Arms 3' and 4" are mounted on respective pivots 5' and 5" lodged in protruding body portions 6', 6" of head part 1. The head part comprises a hollow cylindrical portion 7 which receives a piston 8 connected through a rod 9 to the tail part 2.

The wall 10 of the head part has a number of openings such as 11' and 11" at the height where the grapnel arms are mounted on the body, said arms being cam-shaped at the corresponding end and comprising in particular cam-portions such as 12', 12" which enter the hollow part 7 through openings 11' and 11", respectively. In the example shown in FIGS. 1 to 3, the cam surfaces of portions 12' and 12" have a cylindrical shape, while the arms are substantially flat, and these cam surfaces co-operate with an annular plane surface 13 of piston 8. The shown arrangement assures that the force transmitted by the piston 8 and arms 3', 3" is always directed in the axial direction of the piston. When the piston 8 moves from the position shown in FIG. 1 to the position shown in FIG. 2 the grapnel arms turn around their pivots 5', 5" and move outwardly towards a final position defined by banking surfaces constituted for example by portions 14', 14" and 15', 15" of the arms 3', 3", respectively, and the corresponding portions of the head part 1 such as shown in FIG. 2.

The tail part of the grapnel comprises in the shown example a piston connecting part 16 in which the piston rod 9 is lodged, a rope attaching part 17 and a guide rod 18. These three parts are connected to each other by means of transversal connecting pins such as 19, 20.

The piston connecting part 16 is adapted for sliding inside head part 1 which is provided to this effect with a guiding part 21. In the shown embodiment, piston rod 9 is also mounted for axially sliding with respect to part 16 so as to assure a telescope-like extension of the grapnel body as shown in FIG. 2.

The guide-rod 18 is intended to be placed in a launching tube not shown in the drawing, which launching tube contains a driving arrangement capable of accelerating the grapnel and to place it on a ballistic trajectory with a very high starting speed. Such a driving arrangement is described for instance in Swiss Pat. No. 450 966.

Rope 4 is attached to the grapnel body by means of a part 17 and a sliding ring 22 mounted on the guiding rod 18. The rope 4 forms, at its end by which it is attached to the grapnel, a closed loop crossing the rope attaching part 17 so as to form on either side thereof two substantially equal loop lengths 4', 4'', the rope crossing diametrally opposite openings 22', 22'' of ring 22. In the opening 22' the rope is fixed with respect to ring 22 so as to define the length of rope portion 4' so that in the stretched condition of the rope and more particularly of parts 4', 4'', the sliding ring 22 is in a position near the free end of the guiding rod 18.

The head part of the grapnel is preferably provided with a shock absorber 23 constituted by a bell-shaped part of elastically deformable material to reduce the effects of a shock on the grapnel at the end of its flight.

FIG. 3 shows the shape of the end portions of a grapnel arm from the section along line III—III of FIG. 2. Sidewardly extending blade-like members 24, 25 are arranged near the junction of a main catching point 26 with the grapnel arm. As shown in FIG. 2 an auxiliary catching claw 27 is also provided near the intersection of main point 26 and extends substantially in the direction of the grapnel arm.

For launching the grapnel, the guiding rod 18 is placed inside the above mentioned launching tube while the rope and the sliding ring 22 are placed approximately as shown in FIG. 1. Grapnel arms 3', 3'' etc. are in the retracted position close to the grapnel body, the openings 11', 11'' forming stops to define the closest retracted position of the arms as shown in FIG. 1. The grapnel body is in the position shown in FIG. 1 and has thus its minimal length.

When the grapnel is on its trajectory, the weight of rope 4 will generally produce from a certain moment a traction force on the tail part of the grapnel. At the beginning of that phase the sliding ring 22 will move up to its end position in the neighborhood of rod 18 with rope part 4'' gliding through opening 22'', so that the rope finally takes the shape represented in FIG. 2. When the traction acts on the rope attaching part 17 it will first produce a sliding of part 16 with respect to part 1 and furtheron, once piston rod 9 has reached its final position within part 16 the same will move the piston towards a final position thereof as shown in FIG. 2. The grapnel arms are then in the outwardly extending position but this occurs only well after the initial phase of the launching characterized by a very high acceleration and launching speed. In the retracted position the grapnel arms resist perfectly to the forces acting thereon and are not subject to any permanent deformation.

In certain cases the arms may not open during the flight or they can in the present embodiment retract again at least partially when falling down on the ground so that they will not be damaged by the impact. A traction on rope 4 allows to open the arms by the relative moment between the two main body parts of the grapnel which results from such traction as soon as one of the arms at least has caught ground or any other obstacle. Even on flat ground auxiliary claws 27 will provide sufficient retaining force to allow the opening of grapnel arms and the subsequent hooking of the grapnel by means of its main catching points. The sidewardly extending blade-like members 24, 25 further increase the reliability of the catching action of the grapnel arms.

FIG. 4 shows a similar embodiment of a grapnel according to the invention which is represented in two parts separated by center line A—A to show the two extreme positions of the grapnel arms. The two axially movable body parts of the grapnel are designated in this figure by 41 and 42 and the one grapnel arm shown is designated by reference 43. As previously, a plurality of arms 43 are mounted on corresponding support parts 44 integral with body part 41 so as to allow pivoting of the arms around pivots 45. Cam portions 46 of arms 43 are allowed to penetrate through openings 47 in part 41 into the hollow inside space thereof. Body part 42 has an actuating portion 48 slidably mounted inside hollow part 41 so as to be axially movable with respect to part 41. Part 48 comprises a conical portion 49 and an adjacent cylindrical portion 50. In the retracted position of arms 43 the section of smallest diameter of conical portion 49 is in contact with cam 46 of arm 43. When part 42 moves axially towards the rear with respect to part 41 under the effect of a traction on a rope not shown in the figure, the conical surface 49 acting on cam 46 urges arms 43 to pivot into the outwardly extending position and in the final position the cylindrical portion 50 of part 48 is contacting cams 46 as shown in the upper part of FIG. 4. In this latter position the force transmitted between the actuating member 50 and the grapnel arms is purely radial so that the arms cannot return by themselves to the retracted position once they are in their final outwardly extending position. It is to be noted in connection with this embodiment that part 42 forms also the head part of the grapnel body and is provided with a shock absorbing member 51. As previously, in this embodiment the arms are also urged to open completely under the traction of the rope as soon as they have caught an obstacle by means of their auxiliary claws and the main catching points.

FIG. 4 shows a slightly different embodiment of the main catching points and auxiliary claws 52, 53 of arms 43 as well as blade-like catching members 54. Furthermore, in the embodiment of FIG. 4 the actuating part 48 and the guiding rod 55 are fixed to each other by a connecting pin.

I claim:

1. A grapnel comprising a substantially rod-shaped body, a plurality of grapnel arms and means for attaching a rope, said body comprising at least first and second body parts in longitudinally movable relationship with each other, said grapnel arms being pivotably mounted on said first body part and adapted for pivoting between a retracted position close to the body and a position in which they are outwardly extending from said body, each arm comprising a cam-shaped portion adapted to co-operate with an actuating piston coupled to said second body part so as to urge said arms into the outwardly extending position when said second body part is longitudinally moved with respect to said first body part by a traction on the rope, and wherein said second body part comprises a guiding rod for launching the grapnel along a ballistic trajectory by means of a launching tube, said guiding rod forming the tail portion of said body, said means for attaching a rope comprising means for retaining a first end of at least one loop of said rope on said second body part near the forward end of said guiding rod and comprising a movable attaching member slidably mounted on said guiding rod and retaining a second end of said loop of the rope, so as to retain the rope in the stretched condition thereof near the free end of said guiding rod.

2. A grapnel as claimed in claim 1, wherein each grapnel arm comprises at its free end portion a catching point forming an angle with said arm and comprises near the junction of said catching point with the grapnel part an auxiliary catching claw extending substantially in the direction of said arm.

3. A grapnel as claimed in claim 2, wherein each grapnel arm comprises near the junction of said catching point with the grapnel part sidewardly extending blade-like catching members.

4. A grapnel as claimed in claim 1, wherein each grapnel arm comprises at its free end portion a catching point forming an angle with said arm and comprises near the junction of said catching point with the grapnel part sidewardly extending blade-like catching members.

5. A grapnel as claimed in claim 1, wherein said second body part comprises at least two parts made to telescope.

6. A grapnel as claimed in claim 1, wherein said first body part comprises a hollow part in which said actuating piston is slidably mounted, openings in the walls of said hollow part allowing said cam-shaped arm portions to co-operate with said piston and stop means for defining the end positions of the pivoting arms.

7. A grapnel as claimed in claim 6, wherein said piston and said cam-shaped arm portions have mutually contacting surfaces which are shaped so that the force transmitted through said surfaces has in all relative positions of said arms and said piston a component in the axial direction of the piston.

8. A grapnel as claimes in claim 6, wherein said piston and said cam-shaped arm portions have mutually contacting surfaces which are shaped so that the force transmitted through said surfaces in the outwardly extending position of the arms is perpendicular to the piston axis.

* * * * *